US011280050B2

(12) United States Patent
Yasui

(10) Patent No.: US 11,280,050 B2
(45) Date of Patent: Mar. 22, 2022

(54) TISSUE PAPER

(71) Applicant: Daio Paper Corporation, Ehime (JP)

(72) Inventor: Shuta Yasui, Shizuoka (JP)

(73) Assignee: Daio Paper Corporation, Ehime (JP)

( * ) Notice: Subject to any disclaimer, the term of this patent is extended or adjusted under 35 U.S.C. 154(b) by 0 days.

(21) Appl. No.: 16/976,152

(22) PCT Filed: Feb. 20, 2019

(86) PCT No.: PCT/JP2019/006281
§ 371 (c)(1),
(2) Date: Aug. 27, 2020

(87) PCT Pub. No.: WO2019/167747
PCT Pub. Date: Sep. 6, 2019

(65) Prior Publication Data

US 2020/0407922 A1 Dec. 31, 2020

(30) Foreign Application Priority Data

Feb. 28, 2018 (JP) ..... JP2018-035841

(51) Int. Cl.
*D21H 27/00* (2006.01)
*A47K 10/16* (2006.01)
(Continued)

(52) U.S. Cl.
CPC ..... *D21H 27/005* (2013.01); *A47K 10/16* (2013.01); *D21H 21/14* (2013.01); *D21H 27/30* (2013.01)

(58) Field of Classification Search
CPC ..... D21H 27/005; D21H 21/14; D21H 27/30; D21H 17/06; D21H 27/002; D21H 27/00; D21H 21/24; A47K 16/10; A47K 7/00
See application file for complete search history.

(56) References Cited

U.S. PATENT DOCUMENTS 5,474,689 A * 12/1995 Laughlin ..... C11D 1/62 162/158
5,575,891 A * 11/1996 Trokhan ..... D21H 21/22 162/111
(Continued)

FOREIGN PATENT DOCUMENTS

CN 101144255 A 3/2008
EP 3760088 A1 * 1/2021 ..... D21H 17/06
(Continued)

OTHER PUBLICATIONS

Machine Translation of JP-2011156120 A. (Year: 2011).*
(Continued)

*Primary Examiner* — Jose A Fortuna
(74) *Attorney, Agent, or Firm* — Renner, Kenner; Arthur M. Reginelli

(57) ABSTRACT

The present invention is directed to a two-ply tissue paper including a polyol-containing moisturizer and having excellent softness, smoothness, and strength. In various embodiment, the two-ply tissue paper of the present invention has a basis weight of 16.0 to 25.0 g/m$^2$ per ply, a two-ply paper thickness of 145 to 180 μm, a dry tensile strength of 120 to 200 cN/25 mm in a lateral direction, a dry tensile strength of 275 to 450 cN/25 mm in a longitudinal direction, a wet tensile strength of 60 to 130 cN/25 mm in the lateral direction, a difference of 40 cN/25 mm or more between the dry tensile strength in the lateral direction and the wet tensile strength in the lateral direction and a value of (wet tensile strength in lateral direction)/(dry tensile strength in lateral direction) of 0.60 to 0.75, and an elongation percentage of 13.0 to 18.0% in the longitudinal direction.

3 Claims, 2 Drawing Sheets

(51) Int. Cl.
*D21H 21/14* (2006.01)
*D21H 27/30* (2006.01)

(56) References Cited

U.S. PATENT DOCUMENTS

| | | | | |
|---|---|---|---|---|
| 5,624,532 | A * | 4/1997 | Trokhan | D21H 23/26 162/111 |
| 5,981,044 | A * | 11/1999 | Phan | D21H 17/06 162/127 |
| 6,949,167 | B2 * | 9/2005 | Shannon | D21H 21/16 162/109 |
| 10,570,568 | B2 * | 2/2020 | Yasui | D21H 27/30 |
| 10,844,549 | B2 * | 11/2020 | Yasui | D21H 17/14 |
| 11,001,032 | B2 * | 5/2021 | Vogt | D21H 27/002 |
| 11,076,726 | B2 * | 8/2021 | Vogt | D21F 11/006 |
| 2005/0252626 | A1 * | 11/2005 | Chen | D21H 25/04 162/125 |
| 2007/0137808 | A1 * | 6/2007 | Lostocco | B32B 29/005 162/109 |
| 2008/0207867 | A1 | 8/2008 | Uehara et al. | |
| 2010/0051217 | A1 * | 3/2010 | Allen | D21G 1/00 162/116 |
| 2016/0289897 | A1 * | 10/2016 | Ramaratnam | D21H 21/18 |
| 2017/0260696 | A1 * | 9/2017 | Chou | D21H 27/40 |
| 2018/0258592 | A1 * | 9/2018 | Yasui | A47K 10/16 |
| 2019/0078262 | A1 * | 3/2019 | Vogt | D21H 27/002 |
| 2020/0032459 | A1 * | 1/2020 | Yasui | D21H 17/06 |
| 2020/0299901 | A1 * | 9/2020 | Yasui | A61K 8/0208 |
| 2020/0407922 | A1 * | 12/2020 | Yasui | A47K 10/16 |
| 2021/0040695 | A1 * | 2/2021 | Yoshida | D21H 21/24 |
| 2021/0059484 | A1 * | 3/2021 | Yasui | D21H 27/002 |
| 2021/0198850 | A1 * | 7/2021 | Takahashi | D21H 27/30 |
| 2021/0238808 | A1 * | 8/2021 | Tirimacco | D21H 27/32 |

FOREIGN PATENT DOCUMENTS

| | | | | |
|---|---|---|---|---|
| EP | 3760089 | A1 * | 1/2021 | A47K 7/00 |
| JP | H10-226986 | A | 8/1998 | |
| JP | 2003-024282 | A | 1/2003 | |
| JP | 2004209150 | A * | 7/2004 | |
| JP | 2005-170619 | A | 6/2005 | |
| JP | 2008-064722 | A | 3/2008 | |
| JP | 2009-035833 | A | 2/2009 | |
| JP | 4450552 | B | 4/2010 | |
| JP | 4658056 | A | 1/2011 | |
| JP | 2011-156120 | A | 8/2011 | |
| JP | 2011152403 | A * | 8/2011 | A61Q 19/00 |
| JP | 4875488 | B | 1/2012 | |
| JP | 2013202346 | A * | 10/2013 | |
| JP | 2016-137061 | A | 8/2016 | |
| JP | 2017-055807 | A | 3/2017 | |
| JP | 2017176761 | A * | 10/2017 | D21H 27/00 |
| WO | WO-2017168931 | A1 * | 10/2017 | D21H 23/50 |
| WO | WO-2017209739 | A1 * | 12/2017 | D21H 21/20 |

OTHER PUBLICATIONS

Machine Translation of JP-2016137061 A (Year: 2016).*
Machine Translation of JP-2009035833 A. (Year: 2009).*
International Search Report for corresponding PCT/JP2019/006281 dated Apr. 12, 2019; 3 pp.

* cited by examiner

TISSUE PAPER

TECHNICAL FIELD

The present invention relates to a tissue paper, particularly to a tissue paper containing a moisturizer.

BACKGROUND ART

Some tissue papers contain a moisturizer, and other tissue papers contain no moisturizer. A tissue paper containing a moisturizer is referred to as a moisturizing tissue, a chemical-containing tissue, or the like, is mainly used for direct contact with the skin, for example, for blowing one's nose or removing makeup, and has a moisture content increased by a hygroscopic action of the moisturizer. Note that a tissue paper containing no moisturizer is referred to as a non-moisturizing tissue or the like.

The moisturizing tissue is used mainly for a facial use, that is, often used for blowing one's nose or cleaning the face. The moisturizing tissue is often used for removing makeup in addition to blowing one's nose. For removing makeup, a method for applying various types of makeup removing agents such as a gel type and a cream type to the entire face and then wiping off the makeup removing agent is adopted.

The wiping-off operation is generally performed by sliding the moisturizing tissue along the roundness of the face from the forehead to the chin while gently pressing the moisturizing tissue to firmly press the moisturizing tissue such that the moisturizing tissue absorbs the makeup removing agent. Therefore, the moisturizing tissue needs to have high water absorbency, durability even when absorbing water, firmness, moderate softness, and wiping-off smoothness and comfort when being slid on the skin. Particularly, in such a use for removing makeup, smoothness and firmness when a wiping-off operation is performed in a water-absorbed state are desired.

Meanwhile, the quality of a tissue paper may be evaluated by "softness", "smoothness", and "durability (strength/sense of security)". However, the moisturizing tissue provides feeling of "softness" not provided by a tissue containing no moisturizer, that is, not provided by a non-moisturizing tissue as the moisture content is increased due to a moisturizer. However, meanwhile, due to the increase in moisture content, the moisturizing tissue provides no elasticity but feeling of suppleness, and often has low evaluation in "durability (strength/sense of security)". Furthermore, in terms of "durability (strength/sense of security)", in addition to feeling, when one or more moisturizing tissues are taken out in layers from an outlet on a top surface of a storage box, that is, a so-called pop-up operation is performed in a product in a form in which a plurality of moisturizing tissues is folded, stacked, and stored in the storage box, the moisturizing tissues may break more frequently than a non-moisturizing tissue. In addition, there is also a disadvantage that nasal mucus goes through the moisturizing tissue and adheres to a finger holding the moisturizing tissue when the moisturizing tissue is used for, for example, blowing one's nose.

As described above, in evaluation of a moisturizing tissue, when evaluation of "softness" is increased, evaluation of "durability (strength/sense of security)" is often lowered.

Meanwhile, there are many unclear points about a relationship between paper quality parameters of a tissue paper and sensory evaluation values, and it is difficult to quantitatively evaluate feeling of use of the tissue paper. Conventional sensory evaluation has not examined in detail a difference in the criteria of each item for each subject. Particularly, regarding "softness" and "smoothness", when one subject feels a sense as "softness", another subject may often feel the sense as "smoothness," and therefore the accuracy may be low when "softness" and "smoothness" are judged as individual items. For this reason, it is difficult to develop a tissue paper improving both of the above evaluation items.

CITATION LIST

Patent Literature

Patent Literature 1: JP 4875488 B2
Patent Literature 2: JP 4450552 B2
Patent Literature 3: JP 4658056 B2
Patent Literature 4: JP 2017-55807 A
Patent Literature 5: JP 10-226986 A
Patent Literature 6: JP 2003-24282 A
Patent Literature 7: JP 2008-64722 A

SUMMARY OF INVENTION

Technical Problem

Therefore, a main object of the present invention is to provide a moisturizing tissue having excellent quality concerning sensory performance, particularly having excellent quality concerning sensory performance in actual use by a user, particularly to provide a moisturizing tissue having excellent "softness" and "durability (strength/sense of security)". Furthermore, a main object of the present invention is to provide a moisturizing tissue having a strength equivalent to that of a non-moisturizing tissue, and to provide a moisturizing tissue having excellent "smoothness".

Solution to Problem

Means for solving the above problems are as follows.

A first means is a two-ply tissue paper containing a polyol-containing moisturizer, the two-ply tissue paper having:

a basis weight of 16.0 to 25.0 g/m$^2$ per ply;

a two-ply paper thickness of 145 to 180 μm;

a dry tensile strength of 120 to 200 cN/25 mm in a lateral direction;

a dry tensile strength of 275 to 450 cN/25 mm in a longitudinal direction;

a wet tensile strength of 60 to 130 cN/25 mm in the lateral direction;

a difference of 40 cN/25 mm or more between the dry tensile strength in the lateral direction and the wet tensile strength in the lateral direction and a value of (wet tensile strength in lateral direction)/(dry tensile strength in lateral direction) of 0.60 to 0.75; and an elongation percentage of 13.0 to 18.0% in the longitudinal direction.

The second means is the tissue paper according to the first means, having a surface roughness Ra of 10.0 to 12.0 μm.

The third means is the tissue paper according to the first or second means, having an average friction coefficient μ of 0.38 to 0.50.

The fourth means is the tissue paper according to any one of the first to third means, having a value of (surface roughness Ra)/(average friction coefficient μ) of 25.0 to 30.0 μm, and a value of (wet tensile strength in lateral direction)/[(dry tensile strength in lateral direction)×(average friction coefficient μ)] of 1.45 to 2.00.

Advantageous Effects of Invention

The present invention as described above provides a moisturizing tissue having excellent quality concerning sensory performance, particularly having excellent quality concerning sensory performance in actual use by a user. Particularly, the present invention provides a moisturizing tissue having excellent "softness" and "durability (strength/sense of security)". Furthermore, the present invention provides a moisturizing tissue having a strength equivalent to that of a non-moisturizing tissue. In addition, the present invention provides a moisturizing tissue also having excellent "smoothness".

DESCRIPTION OF EMBODIMENTS

Figure 1:
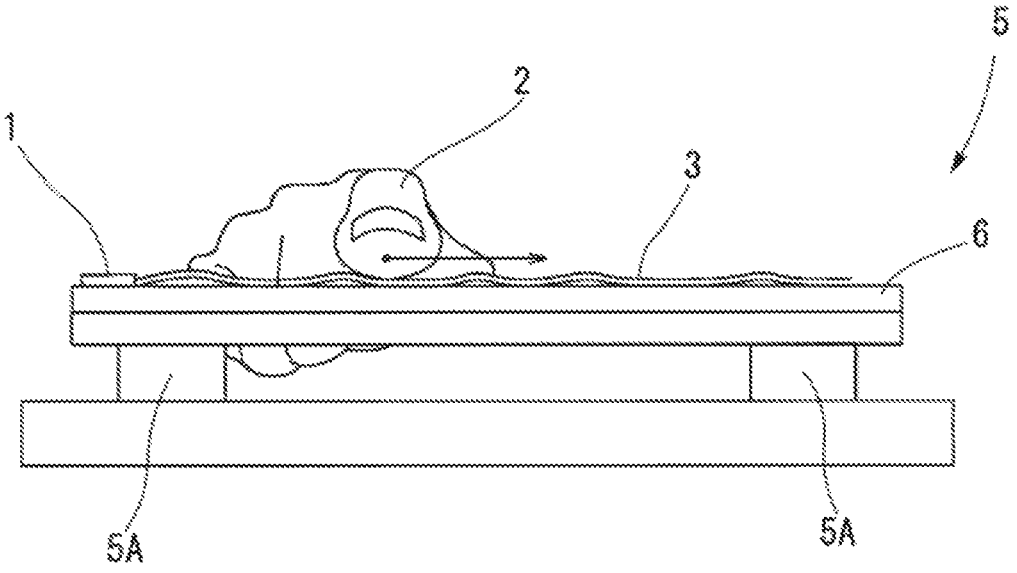
FIG. 1 is a view for explaining a method for measuring a dynamic friction coefficient according to the present invention.

Hereinafter, embodiments of the present invention will be described.

A tissue paper according to the present embodiment is a moisturizing tissue particularly excellent in general "softness" and having "durability (strength/sense of security)". Furthermore, the tissue paper has a strength equivalent to that of a non-moisturizing tissue and also has excellent "smoothness". In addition, when the tissue paper is used for removing makeup, which is one of main uses of a moisturizing tissue, the tissue paper has a sufficient wet tensile strength, and has excellent comfort on the skin when the tissue paper is slid to the chin while being gently pressed to be firmly pressed such that the tissue paper absorbs a gel type or cream type agent.

The tissue paper according to the present embodiment is a two-ply tissue paper, that is, a tissue paper obtained by stacking two base sheets to be integrated into one set. It is desirable that pulp fibers constituting the tissue paper contain needle bleached kraft pulp (NBKP) and leaf bleached kraft pulp (LBKP). Particularly, the pulp fibers preferably contain only NBKP and LBKP. A blend ratio thereof is preferably NBKP:LBKP=20:80 to 80:20, and particularly desirably NBKP:LBKP=30:70 to 60:40. By such blending, a balance between dry and wet tensile strengths and a surface property can be favorably adjusted. It is desirable that NBKP is a needle bleached kraft pulp having a fiber roughness of 11.0 mg/100 m to 20.0 mg/100 m because NBKP provides a flexible base paper having a strength. It is desirable that LBKP is a leaf bleached kraft pulp having a fiber roughness of 7.0 to 13.0 mg/100 m because LBKP provides a base paper having a smooth surface property.

The tissue paper according to the present invention is a two-ply moisturizing tissue as described above, and has a basis weight of 16.0 g/m$^2$ or more per ply. An upper limit value is not necessarily limited. However, it is desirable that the upper limit is 25.0 g/m$^2$. The basis weight of the tissue paper according to the present invention is relatively higher than that of a general-purpose tissue paper called a general-purpose product or a low-priced product. With this basis weight, a tissue paper having excellent softness, smoothness, and durability can be achieved. The tissue paper according to the present invention has a two-ply paper thickness of 145 μm or more. An upper limit value is not limited. However, it is desirable that the upper limit is 180 μm. With this paper thickness, a tissue paper having excellent softness, smoothness, and durability can be achieved.

Note that the basis weight in the present invention means a value measured according to JIS P 8124 (2011). The paper thickness means a value obtained by sufficiently subjecting a test piece to humidity control under conditions of JIS P 8111 (1998), and then measuring the paper thickness using a dial thickness gauge (thickness measuring instrument) "PEACOCK G type" (manufactured by Ozaki MFG. Co., Ltd.) under the same conditions. Specifically, the paper thickness is measured by confirming that there is no rubbish, dust, or the like between a plunger and a measuring table, placing the plunger on the measuring table, moving a scale of the dial thickness gauge to adjust a zero point, then raising the plunger, placing a sample on a test table, lowering the plunger slowly, and reading the current gauge. At this time, the plunger is just placed. A terminal of the plunger is made of metal, and a circular plane thereof with a diameter of 10 mm strikes perpendicularly to a paper plane, and a load is about 70 gf when the paper thickness is measured. An average value obtained by performing the measurement 10 times is used as a paper thickness.

The tissue paper according to the present embodiment is a tissue paper containing a moisturizer, also referred to as a moisturizing tissue, a lotion tissue, a chemical-containing tissue, or the like. The moisturizer according to the present embodiment mainly contains a polyol for taking moisture into a paper due to a hygroscopic property thereof to increase a moisture content. Therefore, the tissue paper according to the present embodiment contains a polyol. The polyol is an aliphatic compound having two or more hydroxy groups —OH, and has an effect of improving a moisture content due to a hygroscopic property thereof. A hygroscopic sugar is also included. Examples of a suitable polyol according to the present embodiment include glycerin, diglycerin, triglycerin, propylene glycol, 1,3-butylene glycol, polyethylene glycol, sorbitol, glucose, xylitol, maltose, maltitol, mannitol, trehalose, arabinose, galactose, xylose, xylobiose, xylooligosaccharide, sucrose, and rhamnose. A mixture thereof may also be used. Examples of a particularly suitable polyol include glycerin, diglycerin, triglycerin, propylene glycol, 1,3-butylene glycol, polyethylene glycol, and a mixture thereof. Among these compounds, glycerin, diglycerin, and a mixture thereof are particularly preferable.

Examples of components other than the main component in the moisturizer according to the present embodiment include aloe extract, Isodon japonicus extract, hypericum extract, barley extract, orange extract, seaweed extract, chamomile extract, cucumber extract, comfrey extract, burdock extract, shiitake mushroom extract, rehmannia root extract, perilla extract, sage extract, duke extract, Cordyceps extract, Houttuynia cordata extract, Lyophyllum decastes extract, loquat extract, grape leaf extract, Tilia cordata extract, prune extract, loofah extract, moutan bark extract, Rosa maikwai extract, peach leaf extract, lily extract, apple extract, almond oil, olive oil, sesame oil, safflower oil, soybean oil, camellia oil, castor oil, jojoba oil, mink oil, coconut oil, beeswax, hyaluronic acid, placenta extract, rhamnose, xylobiose, xylooligosaccharide, tuberose polysaccharide, trisaccharide, soluble collagen, glycyrrhizin, chondroitin sulfate, squalane, a ceramide-like compound, urea, a vitamin C phosphate calcium salt, vitamin E, sodium pyrrolidonecarboxylate, hinokitiol, liquid paraffin, and vaseline. These compounds may be contained singly or in combination of two or more kinds thereof. Among these compounds, aloe extract, Isodon japonicus extract, hypericum extract, comfrey extract, perilla extract, sage extract, a ceramide-like compound, Houttuynia cordata extract, Lyophyllum decastes extract, loquat extract, Tilia cordata extract, moutan bark extract, castor oil, jojoba oil, hyaluronic acid, placenta extract, soluble collagen, chondroitin sulfate, squalane, and urea are more preferable.

The tissue paper according to the present embodiment contains a moisturizer as described above, and thereby particularly has a moisture content of 10% by mass or more, and particularly has a moisture content of 11% by mass or more. This moisture content is extremely high among moisture contents of moisturizing tissues. Note that the moisture content here is a value obtained by subjecting a sample to humidity control under conditions of JIS P 8111 (1998) and then measuring a moisture content on the basis of JIS P 8127 (2010). Specifically, using a tissue paper which has been subjected to humidity control under the standard conditions of JIS P 8111 (1998) as a sample, the tissue paper is dried under a room temperature of 23±1° C. and a relative humidity of 50±2% until a comparable amount is obtained, and a ratio of a moisture amount in the tissue paper with respect to the mass of the humidity-controlled tissue paper is determined.

(moisture content % of tissue paper)=((mass g of humidity-controlled tissue paper)−(mass g of dried tissue paper))/(mass g of humidity-controlled tissue paper))

The content of the moisturizer contained in the tissue paper according to the present embodiment is 22.5% by mass or more and 28.5% by mass or less. The content of a polyol is determined, for example, from a value measured by quantification with a gas chromatography hydrogen flame ionization detector. Using a humidity-controlled tissue paper as a standard sample, acetone extraction is performed with a Soxhlet extractor. The solvent used for extraction is dried, and the resulting product is put into a gas chromatography hydrogen flame ionization detector. A ratio of the total mass of polyols such as glycerin contained in the tissue paper that has been subjected to moisture control under similar conditions to the above moisture content is defined as % by mass of the content of the polyols. With the above content, the moisture content in the tissue paper is easily increased to 10% by mass or more.

The moisturizer in the tissue paper according to the present embodiment is preferably externally added to a base paper as a chemical. The chemical can be externally added to a base paper by a known technique such as spray application, printing application, or roll transfer. Note that the chemical can contain a known auxiliary agent such as an emulsifier, an antiseptic agent, or an antifoaming agent. The content of a polyol in the chemical is preferably 60.0 to 90.0% by mass.

Meanwhile, the tissue paper according to the present embodiment has a dry tensile strength of 120 cN/25 mm or more in a lateral direction and a dry tensile strength of 275 cN/25 mm or more in a longitudinal direction. The values of the dry tensile strength in the lateral and longitudinal directions are extremely high values for a moisturizing tissue, and are almost the same as those of a non-moisturizing tissue. An upper limit value of the dry tensile strength in the longitudinal direction is not necessarily limited. However, it is desirable that the upper limit value is 450 cN/25 mm.

The tissue paper according to the present embodiment has a dry tensile strength of 120 cN/25 mm or more in the lateral direction and a wet tensile strength of 60 cN/25 mm or more in the lateral direction as described above. It is desirable that an upper limit value of the dry tensile strength in the lateral direction is 200 cN/25 mm, and a particularly preferable range of the dry tensile strength in the lateral direction is 130 to 160 cN/25 mm. It is desirable that an upper limit value of the wet tensile strength in the lateral direction is 130 cN/25 mm, and a particularly preferable range of the wet tensile strength in the lateral direction is 80 to 120 cN/25 mm. When the dry tensile strength and the wet tensile strength in the lateral direction are within these ranges in the above-described range of the basis weight, excellent softness is obtained. The tissue paper according to the present invention has an extremely high wet tensile strength particularly in the lateral direction. The wet tensile strength in the lateral direction is generally the weakest value among values of the dry tensile strength of a tissue paper in the longitudinal and lateral directions and values of the wet tensile strength of the tissue paper in the longitudinal and lateral directions. Therefore, when a tissue paper has a high wet tensile strength in the lateral direction, the paper itself can be said to be essentially durable, and easily provides feeling of durability also in terms of how to feel the tissue paper.

In the tissue paper according to the present embodiment, softness and durability are made easily sensible by slightly increasing a moisture content and increasing paper strength as described above.

Here, the tissue paper according to the present embodiment has a difference of 40 cN/25 mm or more between the dry tensile strength in the lateral direction and the wet tensile strength in the lateral direction and a value of (wet tensile strength in lateral direction)/(dry tensile strength in lateral direction) of 0.60 to 0.75. Within this range, a better effect can be exhibited in softness.

Here, the dry tensile strength according to the present embodiment is measured on the basis of the tensile test of JIS P 8113 (2006). As a test piece, a tissue paper cut into a size of about 25 mm (±0.5 mm) (width)×about 150 mm (length) in both the longitudinal and lateral directions is used. In a case of a multi-ply tissue paper, the measurement is performed with multiple plies. As a tester, a load cell tensile tester TG-200N manufactured by Minebea Co., Ltd. is used. A grip interval is set to 100 mm. The measurement is performed by tightening both ends of the test piece to a grip of the tester, applying a tensile load to the paper piece in an up-down direction, and reading an indicated value (digital value) when the paper breaks. A pulling speed is 100 mm/min. Five sets of samples are prepared in each of the longitudinal direction and the lateral direction, and each sample is measured five times. An average of the measured values is defined as a dry tensile strength in each of the directions. (A sample was adjusted according to JIS P 8111 (1998))

A wet tensile strength is measured according to the tensile test of JIS P 8135 (1998). As a test piece, a tissue paper cut into a size of about 25 mm (±0.5 mm) (width)×about 150 mm (length) in both the longitudinal and lateral directions is used. In a case of a multi-ply tissue paper, the measurement is performed with multiple plies. As a tester, a load cell tensile tester TG-200N manufactured by Minebea Co., Ltd. is used. A grip interval is set to 100 mm. The measurement is performed by tightening both ends of the test piece which has been cured for 10 minutes with a dryer at 105° C. to a grip of the tester, then horizontally applying water to a central portion of the test piece with a width of about 10 mm using a flat brush containing water, immediately thereafter applying a tensile load to the paper piece in an up-down direction, and reading a value (digital value) when the paper breaks. A pulling speed is 50 mm/min. Five sets of samples are prepared in each of the longitudinal direction and the lateral direction, and each sample is measured five times. An average of the measured values is defined as a wet tensile strength in each of the directions.

Meanwhile, the tissue paper according to the present embodiment has an elongation percentage (stretch at break) of 13.0 to 18.0% in the longitudinal direction. The elongation percentage is a value measured on the basis of the tensile test of JIS P 8113 (2006). The measurement can be performed by "universal tensile compression tester TG-200N" manufactured by Minebea Co., Ltd. or a machine equivalent thereto. When the elongation percentage is within the above range, the tissue paper easily provides feeling of smoothness.

The tissue paper according to the present embodiment is a moisturizing tissue, and is manufactured by adding a moisturizer to a base paper-stacked sheet such that the content of a polyol is about 22.5% by mass to 28.5% by mass. Generally, the dry tensile strength is often reduced by 30% to 40%, and the wet strength is often reduced by 20% to 30% with respect to a base paper containing no chemical due to moisture in the chemical and moisture absorption after application of the chemical. Therefore, in the tissue paper according to the present embodiment, it is desirable that the dry tensile strength and the wet tensile strength of a primary base paper to be made are significantly increased as compared with those of a conventional product. Specifically, it is desirable that the longitudinal dry tensile strength is 450 to 650 cN/25 mm, the lateral dry tensile strength is 250 to 350 cN/25 mm, and the lateral wet tensile strength is 80 to 150 cN/25 mm. In the present invention, the strength is easily adjusted within this range by adjusting the basis weight of the base paper to 13.5 to 22.5 g/m$^2$ for a one-ply tissue paper and by adjusting the paper thickness to 145 to 200 μm for a two-ply tissue paper.

Furthermore, when the base paper is made, the strength only needs to be adjusted by adjusting blending of raw materials, beating conditions, the kind of a dry paper strength enhancer, the kind of a wet paper strength enhancer, a blending ratio between the dry paper strength enhancer and the wet paper strength enhancer, and the like. However, in order to increase the dry tensile strength and the wet tensile strength, only an increase in the amounts of the dry paper strength enhancer and the wet paper strength enhancer added to the raw materials may cause the yield of a paper strength agent to reach a ceiling, and it may be difficult to achieve necessary dry and wet tensile strengths. Particularly, in order to achieve good evaluation in all of "water absorbency when a tissue paper is used for wiping off", "durability and firmness when the tissue paper absorbs water", "softness when the tissue paper rubs the skin", and "wiping-off smoothness and comfort when the tissue paper is slid on the skin", not by simply increasing the wet tensile strength and the dry tensile strength but by setting a ratio between the wet tensile strength in the lateral direction and the dry tensile strength in the lateral direction ((wet tensile strength in lateral direction)/(dry tensile strength in lateral direction)) to 0.60 to 0.75 to balance the wet tensile strength and the dry tensile strength with each other, the tissue paper has excellent softness and durability, and extremely excellent durability particularly when the tissue paper is wet. Furthermore, it is desirable that the aspect ratio of the tissue paper ((impression tensile strength in longitudinal direction)/(dry tensile strength in lateral direction)) is 2.0 to 2.8. The dry tensile strength in the longitudinal direction can be suppressed to provide soft paper quality and to secure softness during use, and the dry tensile strength in the lateral direction can be increased to secure resistance to break when the tissue paper is wet. In this case, particularly, it is desirable that the aspect ratio (dry tensile strength in longitudinal direction)/(dry tensile strength in lateral direction) of the base paper is 1.5 to 3.0. Within this range, when the tissue paper is formed into a product, the dry tensile strength in the longitudinal direction can be suppressed to provide soft paper quality and to secure softness during use, and the dry tensile strength in the lateral direction can be increased to secure resistance to break when the tissue paper is wet.

Particularly suitable examples of the dry paper strength enhancer in the tissue paper according to the present embodiment include cationized starch and a cationic or amphoteric polyacrylamide-based copolymer. Particularly, cationized starch is desirable as the dry paper strength enhancer. It is desirable that the content of the dry paper strength enhancer is 0.01 to 0.20 parts by mass with respect to 100 parts by mass of pulp fibers. Examples of the wet paper strength enhancer include a urea formaldehyde resin, a melamine formaldehyde resin, polyamide polyamine epichlorohydrin (PAE), and polyvinyl amine (PVAm). Particularly, a polyaminopolyamine epichlorohydrin resin is desirable as the wet paper strength enhancer. It is desirable that the content of the wet paper strength enhancer is 0.1 to 1.0 part by mass with respect to 100 parts by mass of pulp fibers. A polyaminopolyamine epichlorohydrin resin and cationized starch can effectively improve paper strength without inhibiting an effect of improving softness and smoothness due to an increase in moisture content by a polyol. By using the polyaminopolyamine epichlorohydrin resin and cationized starch, the tissue paper according to the present embodiment has better softness and smoothness, has an improved strength, and has an extremely high sensory evaluation value by a consumer. Note that it is desirable that the dry paper strength enhancer and the wet paper strength enhancer are internally added.

Specifically, when 8.0 to 10.0 kg/pulp ton polyamide polyamine epichlorohydrin (PAE) is added to 4.0 to 8.0 kg/pulp ton cationized starch, fixing of both cationized starch and polyamide polyamine epichlorohydrin (PAE) to pulp is improved, and the dry tensile strength and the wet tensile strength, particularly the wet tensile strength is remarkably improved. A ratio between cationized starch and polyamide polyamine epichlorohydrin (PAE) having a high fixing ratio and a high effect of improving the dry tensile strength and the wet tensile strength is preferably 30:70 to 55:45. Within this range, fixing of both the dry paper strength enhancer and the wet paper strength enhancer to raw materials is favorable, and desired dry and wet tensile strengths can be obtained.

Meanwhile, the tissue paper according to the present embodiment does not have to contain an internal addition softener to be internally added when a base paper is made. The softener can increase softness of the base paper itself, but it affects the paper strength, and particularly tends to decrease the paper strength. In the tissue paper according to the present embodiment, by adding no internal addition softener to the tissue paper or decreasing the use amount thereof, adjusting the paper strength of the base paper to a high value, and enhancing the action of a moisturizer, particularly a polyol, high sensory evaluation in terms of softness, smoothness, and durability is easily obtained. Note that when a softener is used, suitable examples of the softener include a fatty acid ester-based compound and a fatty acid amide-based compound. The fatty acid amide-based compound has an effect of coating a fiber surface and is suitable for the tissue paper according to the present embodiment. The fatty acid ester-based compound has an effect of improving wettability and plumpness (fluffiness) of a surface of the tissue paper.

The fatty acid ester-based compound may be either a cationic fatty acid ester-based compound or a nonionic fatty acid ester-based compound, but it is desirable that both of these compounds are contained. It is desirable that the fatty acid ester-based compound is a compound of an alcohol having 6 to 24 carbon atoms and a fatty acid having 7 to 25 carbon atoms. The alcohol may be any one of a linear alcohol, a branched alcohol, a saturated alcohol, and an unsaturated alcohol. Particularly, an alcohol having 10 to 22 carbon atoms is preferable, and lauryl alcohol, myristyl alcohol, cetyl alcohol, stearyl alcohol, behenyl alcohol, and oleyl alcohol are preferable. These alcohols may be used singly or in combination of two or more kinds thereof. The fatty acid having 7 to 25 carbon atoms may be any one of a linear fatty acid, a branched fatty acid, a saturated fatty acid, and an unsaturated fatty acid. Particularly, a fatty acid having 10 to 22 carbon atoms is preferable, and lauric acid, myristic acid, palmitic acid, stearic acid, behenic acid, and oleic acid are preferable. These alcohols may be used singly or in combination of two or more kinds thereof.

The fatty acid amide-based compound can be obtained by a reaction between a polyalkylene polyamine and a carboxylic acid. A suitable polyalkylene polyamine is a compound having at least three amino groups in a molecule thereof, represented by the following formula (1).

$$H_2N—(R_1—NH—)_n—R_1—NH_2 \quad (1)$$

($R_1$s each independently represent an alkylene group having 1 to 4 carbon atoms, and n represents an integer of 1 to 3)

In this polyacrylic amine, different $R_1$s may exist in a molecule thereof. Two or more polyalkylene polyamines can also be used. $R_1$ is preferably an ethylene group. It is desirable that the carboxylic acid is a carboxylic acid having 10 to 24 carbon atoms. The carboxylic acid may be either a saturated carboxylic acid or an unsaturated carboxylic acid. The carboxylic acid may be either a linear carboxylic acid or a branched carboxylic acid. Among these carboxylic acids, a carboxylic acid having 12 to 22 carbon atoms is preferable, and a carboxylic acid having 14 to 18 carbon atoms is particularly preferable.

In a case where a softener is contained, when the softener is a fatty acid ester-based compound, the content of the fatty acid ester-based compound is 0.01 parts by mass to 0.20 parts by mass with respect to 100 parts by mass of pulp fibers, and when the softener is a fatty acid amide-based compound, the content of the fatty acid amide-based compound is 0.01 parts by mass to 0.30 parts by mass with respect to 100 parts by mass of pulp fibers.

Meanwhile, it is desirable that the tissue paper according to the present embodiment has a value of surface roughness Ra of 10.0 μm or more. An upper limit value is 12.0 μm. When the value of surface roughness Ra is 10.0 μm to 12.0 μm, the tissue paper easily provides feeling of smoothness and good texture. The surface roughness Ra here is a surface roughness according to ISO 25178-2: 2012. In an artificial weather room controlled to room temperature of 23° C. and relative humidity of 50%, which is the condition of JIS P 8111 (1998), the arithmetic average roughness Ra (surface roughness, μm) of a test piece cut into 10 cm square is calculated according to ISO 25178 using a laser microscope VR-3200 manufactured by KEYENCE CORPORATION and a machine equivalent thereto. Note that "VR-H1A" manufactured by KEYENCE CORPORATION can be used as software for observing, measuring, and analyzing an image of the laser microscope. Note that measurement is performed under conditions of a magnification of 12 times and a visual field area of 24 mm×18 mm. However, the measurement magnification and the visual field area may be appropriately changed.

Meanwhile, the tissue paper according to the present embodiment has a value of dynamic friction coefficient (average friction coefficient μ) of 0.38 or more. An upper limit value of dynamic friction coefficient (average friction coefficient μ) is 0.50. Particularly, it is desirable that the value of dynamic friction coefficient (average friction coefficient μ) is 0.38 to 0.45. The dynamic friction coefficient (average friction coefficient μ) here means a value measured as follows. Using a tactile force plate TF-2020 (indicated by reference character 5 in the drawing) sold by Tec Gihan Co., Ltd. and an article equivalent thereto, a friction coefficient is measured when an operation similar to that in a sliding sensory evaluation test is performed. As illustrated in FIG. 1, a tissue paper 3 is placed in a generated state on a plate 6 on a load cell 5A, and one end of the tissue paper 3 is fixed onto the plate 6 with an adhesive tape 1 or the like. Next, a friction test is performed by sliding a right index finger 2 in one direction perpendicular to a longitudinal direction of the finger so as to trace the tissue paper 3 to measure a friction coefficient. Note that the tissue paper is fixed such that the sliding direction is a lateral direction of the paper. A test is performed such that a vertical load at the time of measurement is about 0.34±0.09 N, a sliding speed is 76±23 mm/S, and a sliding distance is 103±15 mm. Note that a person who performs measurement may practice several times in advance. The vertical load and the sliding speed are an average vertical load and an average sliding speed obtained by stably detecting a surface property of the tissue paper. The direction of tracing the tissue paper with the right index finger is a direction of friction felt by the fingertip first. Note that the measurement is performed by nine persons, and the same sample (notation is changed) is measured repeatedly five times. An average value obtained by excluding an abnormal value is defined as a friction coefficient.

The surface roughness Ra and the dynamic friction coefficient (average friction coefficient μ) are easily adjusted by the above-described adjustment of paper strength and inclusion of a moisturizer, and further by setting the crepe ratio of the base paper to 20% or less, particularly 18% or less, and more preferably 15% or less, and externally adding the moisturizer to a base paper. The surface roughness Ra and the dynamic friction coefficient (average friction coefficient μ) are also adjusted by adjusting a creping doctor and a pulp blending ratio. Of course, another adjustment technique can be used. For example, the surface roughness Ra and the dynamic friction coefficient (average friction coefficient μ) can also be adjusted by using a fatty acid ester-based compound or a fatty acid amide-based compound as a softener.

It is desirable that the tissue paper according to the present embodiment has a water absorption capacity of 400 to 500 $g/m^2$. This water absorption capacity is sufficient not only for blowing one's nose but also for wiping off a chemical used in order to remove makeup. Note that the water absorption capacity is a value measured as follows. A test piece is prepared by cutting a tissue paper into a size of 100 mm×100 mm (±1 mm) in the longitudinal and lateral directions according to a test quantity. The test piece is cured in a dryer at about 105° C. for three minutes. Tap water as a test solution and a plastic vat to contain the test piece and the test solution are prepared. A wire mesh in which an outer frame has a size of 120 mm×120 mm and a wire thickness of 3.0 mm, and an inner frame has a shape of a 10 mm grid and a wire thickness of 0.5 mm is used. A handle is attached to the wire mesh. A cut test piece is weighed on a container, and the weight is recorded to the third decimal place. The test piece is placed on the wire mesh in parallel to the wire mesh and immersed in the test solution. After the test piece is immersed in the test solution up to a surface of the test piece, the wire mesh is raised vertically to the container containing the test solution to a height of 6 cm and is kept stationary for 30 seconds. 30 seconds later, the test piece is grabbed with tweezers and put into a container from the wire mesh such that the test piece is slid parallel to the wire mesh. The test piece is weighed to determine the weight of water absorbed, and the weight is recorded to the second decimal place. The same sample is measured five times, and an average value of the measured values is defined as a measured value.

Note that the tissue paper according to the present embodiment is suitable for use as a pop-up type tissue paper product contained in a storage box also called a carton box. In this case, in order to form a pop-up type bundle of tissue paper to be contained in the storage box, it is desirable to use a rotary type inter folder having excellent folding quality.

Next, description will be made on the fact that the tissue paper according to the present embodiment is excellent in general "softness" and "smoothness" and "durability", and is also excellent in a specific use mode such as use for removing makeup. First, in order to evaluate feeling of use of a tissue paper, in general, sensory evaluation is performed in which evaluation items such as "softness", "smoothness", and "durability" are set, a plurality of subjects judges feeling of use by comparison with a reference sample for each of the items, and the feeling of use is converted into numerical values for each of the items. Meanwhile, the characteristics of a tissue paper are determined by paper quality parameters such as tensile strength when the tissue paper is dry or wet, elongation at break, basis weight, paper thickness, moisture content, softness (bending resistance), MMD, dynamic friction coefficient (average friction coefficient μ), and surface roughness Ra. However, there are many unclear points about a relationship between paper quality parameters of a tissue paper and sensory evaluation values, and it is difficult to quantitatively evaluate feeling of use of the tissue paper. In the sensory evaluation for evaluation items set in advance, a difference in the criteria of each item between subjects has not been examined in detail. Particularly, regarding "softness" and "smoothness", when one subject feels a sense as "softness", another subject may often feel the sense as "smoothness", and therefore the accuracy may be low when "softness" and "smoothness" are judged as individual items.

Therefore, for five kinds of commercially available moisturizing tissue papers, three kinds of non-moisturizing luxury tissue papers, and seven kinds of non-moisturizing general-purpose tissue papers, sliding sensory evaluation was performed in which a plurality of tissue papers having different physical property values is scored by a method for scoring slidability when the finger is slid on a tissue paper fixed onto a horizontal table according to a judgement criteria of "favorable" or "unfavorable". In this sliding sensory evaluation, the operation of sliding the finger on a tissue paper fixed onto a horizontal table is performed. Therefore, a sense regarding bending of the tissue paper as a reference is eliminated, and feeling of "softness" by a subject is considerably eliminated, and almost "smoothness" can be evaluated. In addition, this sliding sensory evaluation particularly restricts the operation to sliding, and performs scoring according to a judgement criteria of "favorable" or "unfavorable" for an evaluation criteria. Therefore, it is not simply judged whether sliding is good or poor, but evaluation is performed from a viewpoint of the texture of a tissue paper. It has been confirmed that a result of this sliding sensory evaluation is close to feeling felt by a subject mainly as "general smoothness" with few "softness" factors. Then, by performing multiple regression analysis by a stepwise method using a result of sliding sensory evaluation in this sliding sensory evaluation as an objective variable and using a paper quality parameter of a tissue paper as an explanatory variable to clarify a paper quality parameter related to general "smoothness", it is confirmed that there is a correlation between surface roughness Ra and a dynamic friction coefficient (average friction coefficient μ).

Meanwhile, in order to perform evaluation in a specific use of makeup removal in the tissue paper according to the present embodiment, sensory evaluation was performed in which specific evaluation items such as "water absorbency when a tissue paper is used for wiping off", "durability and firmness when the tissue paper absorbs water", "softness when the tissue paper rubs the skin", and "wiping-off smoothness and comfort when the tissue paper is slid on the skin" were set, a plurality of subjects judged feeling of use by comparison with a reference sample for each of the items, and the feeling of use was converted into numerical values for each of the items. In this sensory evaluation, ten women used tissue papers for removing makeup, and graded the tissue papers in seven grades of 1 to 7 in which the most commonly used commercially available product A (non-moisturizing tissue) on the market was used as a reference having an evaluation score of 4. An average value of the evaluation scores of the ten persons is described in Table 1 below. For removing makeup, gel type "Curel Gel Makeup Remover" manufactured by Kao Corporation was used.

Regarding the sensory evaluation of "softness when the tissue paper rubs the skin", particularly when a value obtained by dividing surface roughness Ra by a dynamic friction coefficient (average friction coefficient μ) falls within a range of 25.0 to 30.0 μm, outside which the value of a conventional product is, it has been found that a tissue paper is extremely excellent in "wiping-off smoothness and comfort when the tissue paper is slid on the skin".

Regarding the sensory evaluation of "wiping-off smoothness and comfort when the tissue paper is slid on the skin", particularly when a value obtained by dividing wet tensile strength in the lateral direction by a value obtained by multiplying dry tensile strength in the lateral direction by a dynamic friction coefficient (average friction coefficient μ) [(wet tensile strength in lateral direction)/(dry tensile strength in lateral direction)×(dynamic friction coefficient (average friction coefficient μ)] falls within a range of 1.45 to 2.00, outside which the value of a conventional product is, it has been found that a tissue paper is extremely excellent in "wiping-off smoothness and comfort when the tissue paper is slid on the skin".

The tissue paper according to the present embodiment is excellent in general "softness" and "smoothness" described in the above evaluation method and "durability", further has paper quality parameters not possessed by a conventional product excellent in a specific use mode such as use for removing makeup, and is obtained by adjusting a paper strength and the like in order to obtain the tissue paper.

Note that softness and MMD among the paper quality parameters used to confirm the above-described correlation are as follows.

[Softness]

Softness was measured on the basis of a handle-o-meter method according to a JIS L 1096 (2010) E method. However, a test piece had a size of 100 mm×100 mm, and a clearance was set to 5 mm. Measurement was performed five times in each of a longitudinal direction and a lateral direction with a one-ply tissue paper, and an average value of all the ten values was represented in unit of cN/100 mm.

[MMD]

While a contact surface of a friction element is brought into contact with a surface of a measurement sample to which a tension of 20 g/cm is applied in a predetermined direction at a contact pressure of 25 g, the measurement sample is moved by 2 cm in substantially the same direction as the direction in which the tension is applied at a speed of 0.1 cm/s, and a friction coefficient at this time is measured using a friction sense tester KES-SE (manufactured by Kato Tech Co., Ltd.). A value obtained by dividing the friction coefficient by a friction distance (moving distance=2 cm) is MMD. The friction element is formed by adjoining 20 piano wires P each having a diameter of 0.5 mm, and has a contact surface formed such that the length and the width were both 10 mm. On the contact surface, a unit bulging portion having a tip formed with 20 piano wires P (radius of curvature: 0.25 mm) is formed.

EXAMPLES

Figure 2:
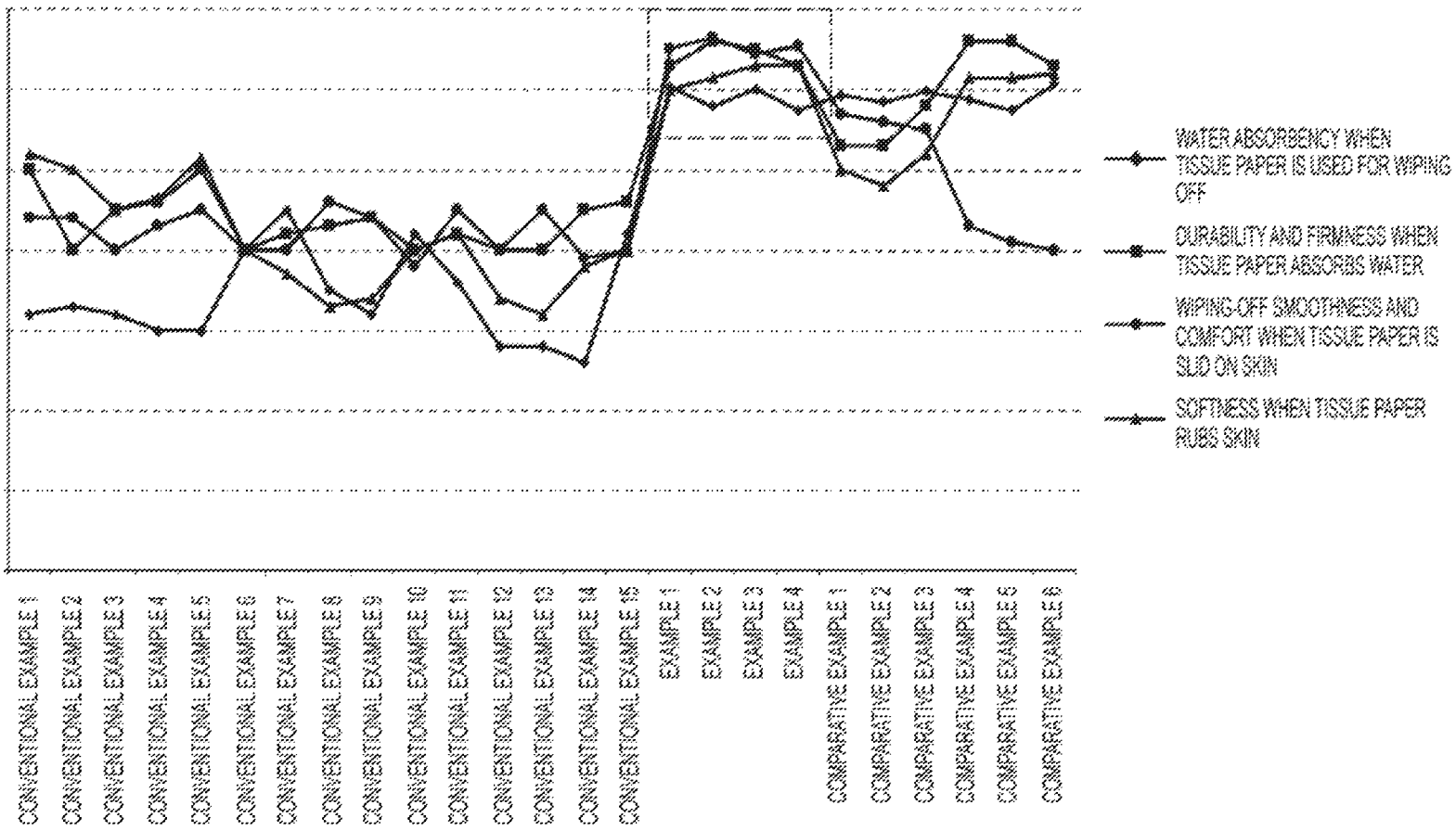
FIG. 2 is a graph illustrating results of sensory evaluation in Examples.

Next, physical property values and results of sensory evaluation in the moisturizing tissue paper according to the present embodiment (Examples 1 to 4), Comparative Examples thereof 1 to 6, and samples used in sliding sensory evaluation (Conventional Examples 1 to 15) are illustrated in Table 1. FIG. 2 illustrates a graph of the results of sensory evaluation.

Here, in Examples, a two-ply moisturizing tissue paper containing a chemical was used. In Example 1, raw material pulps were blended by setting a ratio of NBKP:LBKP to 50:50 such that the ratio of NBKP was slightly high, and paper was made with a circular net Yankee dryer paper machine. In order to adjust a friction coefficient, the angle of a doctor blade and a crepe ratio were adjusted.

Cationic starch was used as a dry paper strength agent, and a polyaminopolyamine epichlorohydrin resin was used as a wet paper strength agent. Two sheets of the tissue paper base paper were stacked to form a stacked tissue paper base paper, and a moisturizer was added in an amount of about 20 to 30% by mass to the stacked tissue paper base paper depending on the basis weight and the like by a gravure printing method such that the content of a polyol was as illustrated in Table. As the chemical, an aqueous chemical containing glycerin as a main component, 75% by mass of glycerin, 20% by mass of water, and 5% by mass of other auxiliary components was used. The aqueous chemical had a viscosity of 110 mPa·s at 40° C.

The stacked continuous sheet containing the moisturizer was processed by a rotary type inter folder to obtain a cut sheet. Note that tension was adjusted in the rotary type inter folder. The paper strength was adjusted mainly by adjusting the content of the paper strength agent.

TABLE 1

| | | | Example 1 | Example 2 | Example 3 | Example 4 | Comparative Example 1 | Comparative Example 2 | Comparative Example 3 |
|---|---|---|---|---|---|---|---|---|---|
| Making of base paper | Blending of pulp (NBKP) | % | 50 | 50 | 50 | 50 | 50 | 50 | 55 |
| | Blending of pulp (LBKP) | % | 50 | 50 | 50 | 50 | 50 | 50 | 45 |
| | Crepe ratio | % | 14 | 14 | 14 | 14 | 14 | 14 | 14 |
| | Softener | kg/pulp ton | 0 | 0 | 0 | 0 | 0 | 0 | 0 |
| | Dry paper strength agent (cationized starch) | kg/pulp ton | 5 | 5 | 5 | 5 | 0 | 0 | 7 |
| | Wet paper strength agent (polyaminopolyamine epichlorohydrin resin) | kg/pulp ton | 10.25 | 10.25 | 10.25 | 10.25 | 8.5 | 8.5 | 8.5 |
| Quality of base paper | Base weight | $g/m^2$ | 15.0 | 15.0 | 15.3 | 15.3 | 14.4 | 14.7 | 14.7 |
| | Paper thickness | μm | 158 | 164 | 170 | 170 | 152 | 153 | 153 |
| | Dry tensile strength in longitudinal direction | cN/25 mm | 448 | 510 | 556 | 489 | 235 | 318 | 314 |
| | Dry tensile strength in lateral direction | cN/25 mm | 268 | 311 | 330 | 295 | 215 | 274 | 322 |
| | Wet tensile strength in lateral direction | cN/25 mm | 92 | 111 | 121 | 112 | 60 | 67 | 100 |
| Moisturizer | Kind of tissue | | Mois-turizing | Mois-turizing | Mois-turizing | Mois-turizing | Mois-turizing | Mois-turizing | Mois-turizing |
| | Content of polyol in paper | % by mass | 19.4 | 19.3 | 19.8 | 19.8 | 19.4 | 19.3 | 19.3 |
| | Base weight | $g/m^2$ | 17.5 | 17.5 | 18.0 | 18.0 | 16.9 | 17.2 | 17.2 |
| | Number of plies | sheets | 2 | 2 | 2 | 2 | 2 | 2 | 2 |
| Parameters of paper quality | Paper thickness | μm | 150 | 156 | 162 | 162 | 145 | 146 | 146 |
| | Dry tensile strength in longitudinal direction | cN/25 mm | 342 | 388 | 420 | 380 | 175 | 239 | 239 |
| | Dry tensile strength in lateral direction | cN/25 mm | 131 | 153 | 160 | 139 | 100 | 131 | 156 |
| | Elongation in longitudinal direction | % | 14.5 | 16.1 | 17.3 | 17.3 | 11.4 | 13.4 | 13.4 |
| | Wet tensile strength in lateral direction | cN/25 mm | 85 | 103 | 112 | 99 | 53 | 62 | 88 |
| | Surface roughness Ra | μm | 11.2 | 10.9 | 11.6 | 11.1 | 12.3 | 11.3 | 11.9 |
| | Average friction coefficient (μ) | — | 0.43 | 0.41 | 0.45 | 0.39 | 0.52 | 0.51 | 0.54 |

TABLE 1-continued

| | | | | | | | | | |
|---|---|---|---|---|---|---|---|---|---|
| | Softness | cN/100 mm | 1.2 | 1.4 | 1.5 | 1.5 | 0.8 | 0.9 | 0.9 |
| | MMD | — | 7.0 | 7.6 | 7.9 | 7.9 | 8.2 | 7.6 | 7.6 |
| | Web volume | mm | 80.0 | 81.0 | 80.2 | 80.2 | 80.5 | 81.0 | 81.0 |
| | Water absorption amount | g/m$^2$ | 456 | 452 | 478 | 455 | 443 | 444 | 448 |
| | Moisture content | % | 12.0 | 12.3 | 12.6 | 12.6 | 12.2 | 12.0 | 11.8 |
| | (Lateral dry strength) − (Lateral wet strength) | cN/25 mm | 46 | 50 | 48 | 40 | 47 | 69 | 58 |
| | (Lateral wet strength)/ (Lateral dry strength) | — | 0.65 | 0.67 | 0.70 | 0.71 | 0.53 | 0.47 | 0.56 |
| | (Lateral wet strength)/ [(Lateral dry strength) × (Average friction coefficient)] | — | 1.51 | 1.64 | 1.58 | 1.83 | 1.02 | 093 | 1.04 |
| | (Surface roughness)/ (Average friction coefficient) | μm | 26.0 | 26.6 | 25.8 | 28.5 | 23.7 | 22.2 | 22.0 |
| | (Longitudinal dry strength/ Lateral dry strength) | — | 2.6 | 2.5 | 2.6 | 2.7 | 1.8 | 1.8 | 1.5 |
| Results of sensory evaluation Evaluation based on seven grades | Water absorbency when tissue paper is used for wiping off | 1 to 7 | 6.0 | 5.8 | 6.0 | 5.7 | 5.9 | 5.9 | 6.0 |
| | Durability and firmness when tissue paper absorbs water | 1 to 7 | 6.3 | 6.6 | 6.5 | 6.3 | 5.3 | 5.3 | 5.8 |
| | Softness when tissue paper rubs skin | 1 to 7 | 6.0 | 6.2 | 6.3 | 6.3 | 5.0 | 4.8 | 5.2 |
| | Wiping-off smoothness and comfort when tissue paper is slid on skin | 1 to 7 | 6.5 | 6.6 | 6.4 | 6.5 | 5.7 | 5.6 | 5.5 |

| | | | Comparative Example 4 | Comparative Example 5 | Comparative Example 6 | Conventional Example 1 | Conventional Example 2 | Conventional Example 3 |
|---|---|---|---|---|---|---|---|---|
| Making of base paper | Blending of pulp (NBKP) | % | 55 | 60 | 50 | 50 | — | — |
| | Blending of pulp (LBKP) | % | 45 | 40 | 50 | 50 | — | — |
| | Crepe ratio | % | 14 | 14 | 14 | 14 | — | — |
| | Softener | kg/pulp ton | 0 | 0 | 0 | 0 | — | — |
| | Dry paper strength agent (cationized starch) | kg/pulp ton | 8 | 8 | 0 | 0 | — | — |
| | Wet paper strength agent (polyaminopolyamine epichlorohydrin resin) | kg/pulp ton | 14 | 14 | 14 | 8.5 | — | — |
| Quality of base paper | Base weight | g/m$^2$ | 14.6 | 14.3 | 14.3 | 15.0 | — | — |
| | Paper thickness | μm | 151 | 149 | 149 | 159 | — | — |
| | Dry tensile strength in longitudinal direction | cN/25 mm | 598 | 691 | 691 | 256 | — | — |
| | Dry tensile strength in lateral direction | cN/25 mm | 320 | 356 | 220 | 174 | — | — |
| | Wet tensile strength in lateral direction | cN/25 mm | 135 | 146 | 96 | 55 | — | — |
| Moisturizer | Kind of tissue | | Mois-turizing | Mois-turizing | Mois-turizing | Mois-turizing | Mois-turizing | Mois-turizing |
| | Content of polyol in paper | % by mass | 19.1 | 19.0 | 19.0 | 19.4 | 18.5 | 13.5 |
| | Base weight | g/m$^2$ | 17.0 | 16.7 | 16.7 | 17.5 | 18.0 | 14.7 |
| | Number of plies | sheets | 2 | 2 | 2 | 2 | 2 | 2 |
| Parameters of paper quality | Paper thickness | μm | 144 | 142 | 142 | 151 | 174 | 140 |
| | Dry tensile strength in longitudinal direction | cN/25 mm | 457 | 528 | 528 | 194 | 238 | 253 |
| | Dry tensile strength in lateral direction | cN/25 mm | 154 | 172 | 103 | 80 | 51 | 73 |
| | Elongation in longitudinal direction | % | 18.2 | 19.0 | 19.0 | 12.4 | 14.5 | 13.1 |
| | Wet tensile strength in lateral direction | cN/25 mm | 125 | 136 | 86 | 50 | 32 | 34 |
| | Surface roughness Ra | μm | 12.3 | 13.2 | 11.0 | 10.0 | 8.5 | 9.7 |
| | Average friction coefficient (μ) | — | 0.61 | 0.66 | 0.59 | 0.48 | 0.47 | 0.52 |
| | Softness | cN/100 mm | 2.1 | 2.2 | 22 | 0.9 | 1.0 | 0.7 |
| | MMD | — | 7.6 | 7.6 | 7.6 | 8.2 | 5.6 | 7.7 |
| | Web volume | mm | 80.4 | 80.6 | 80.6 | 80.0 | 83.0 | 58.0 |
| | Water absorption amount | g/m$^2$ | 447 | 440 | 448 | 272 | 284 | 286 |
| | Moisture content | % | 12.3 | 12.3 | 12.4 | 12.6 | 8.6 | 9.0 |
| | (Lateral dry strength) − (Lateral wet strength) | cN/25 mm | 29 | 37 | 17 | 30 | 19 | 39 |
| | (Lateral wet strength)/ (Lateral dry strength) | — | 0.81 | 0.79 | 0.83 | 0.63 | 0.63 | 0.47 |
| | (Lateral wet strength)/ [(Lateral dry strength) × (Average friction coefficient)] | — | 1.33 | 1.19 | 1.42 | 1.30 | 1.34 | 0.89 |
| | (Surface roughness)/ (Average friction coefficient) | μm | 20.2 | 20.0 | 18.6 | 20.8 | 18.2 | 18.5 |
| | (Longitudinal dry strength/ Lateral dry strength) | — | 3.0 | 3.1 | 5.1 | 2.4 | 4.7 | 3.5 |

TABLE 1-continued

| | | | | | | | | |
|---|---|---|---|---|---|---|---|---|
| Results of sensory evaluation Evaluation based on seven grades | Water absorbency when tissue paper is used for wiping off | 1 to 7 | 5.9 | 5.8 | 6.1 | 3.2 | 3.3 | 3.2 |
| | Durability and firmness when tissue paper absorbs water | 1 to 7 | 6.6 | 6.6 | 6.3 | 5.0 | 4.0 | 4.5 |
| | Softness when tissue paper rubs skin | 1 to 7 | 6.2 | 6.2 | 6.2 | 5.2 | 5.0 | 4.5 |
| | Wiping-off smoothness and comfort when tissue paper is slid on skin | 1 to 7 | 4.3 | 4.1 | 4.0 | 4.4 | 4.4 | 4.0 |

| | | | Conventional Example 4 | Conventional Example 5 | Conventional Example 6 | Conventional Example 7 | Conventional Example 8 | Conventional Example 9 |
|---|---|---|---|---|---|---|---|---|
| Making of base paper | Blending of pulp (NBKP) | % | — | 40 | — | — | — | — |
| | Blending of pulp (LBKP) | % | — | 80 | — | — | — | — |
| | Crepe ratio | % | — | 14 | — | — | — | — |
| | Softener | kg/pulp ton | — | 0 | — | — | — | — |
| | Dry paper strength agent (cationized starch) | kg/pulp ton | — | 0 | — | — | — | — |
| | Wet paper strength agent (polyaminopolyamine epichlorohydrin resin) | kg/pulp ton | — | 8.5 | — | — | — | — |
| Quality of base paper | Base weight | $g/m^2$ | — | 12.4 | — | — | — | — |
| | Paper thickness | μm | — | 146 | — | — | — | — |
| | Dry tensile strength in longitudinal direction | cN/25 mm | — | 281 | — | — | — | — |
| | Dry tensile strength in lateral direction | cN/25 mm | — | 176 | — | — | — | — |
| | Wet tensile strength in lateral direction | cN/25 mm | — | 58 | — | — | — | — |
| Moisturizer | Kind of tissue | | Mois-turizing | Mois-turizing | Non-mois-turizing | Non-mois-turizing | Non-mois-turizing | Non-mois-turizing |
| | Content of polyol in paper | % by mass | 18.0 | 17.6 | — | — | — | — |
| | Base weight | $g/m^2$ | 16.2 | 14.3 | 13.3 | 16.1 | 13.3 | 11.0 |
| | Number of plies | sheets | 2 | 2 | 2 | 2 | 2 | 2 |
| Parameters of paper quality | Paper thickness | μm | 156 | 139 | 142 | 190 | 123 | 101 |
| | Dry tensile strength in longitudinal direction | cN/25 mm | 330 | 216 | 394 | 289 | 259 | 524 |
| | Dry tensile strength in lateral direction | cN/25 mm | 85 | 83 | 90 | 102 | 142 | 161 |
| | Elongation in longitudinal direction | % | 11.3 | 14.6 | 14.3 | 14.2 | 13.5 | 14.8 |
| | Wet tensile strength in lateral direction | cN/25 mm | 41 | 51 | 30 | 35 | 36 | 37 |
| | Surface roughness Ra | μm | 8.6 | 9.7 | 10.5 | 8.6 | 10.0 | 8.1 |
| | Average friction coefficient (μ) | — | 0.54 | 0.50 | 0.50 | 0.60 | 0.47 | 0.52 |
| | Softness | cN/100 mm | 0.8 | 0.9 | 1.1 | 1.1 | 1.2 | 1.0 |
| | MMD | — | 6.4 | 7.4 | 7.0 | 5.7 | 7.8 | 7.0 |
| | Web volume | mm | 82.0 | 60.0 | 62.0 | 106.0 | 64.0 | 56.0 |
| | Water absorption amount | $g/m^2$ | 258 | 252 | 362 | 428 | 333 | 285 |
| | Moisture content | % | 9.3 | 10.3 | 7.4 | 7.1 | 6.7 | 6.7 |
| | (Lateral dry strength) − (Lateral wet strength) | cN/25 mm | 44 | 32 | 60 | 67 | 108 | 124 |
| | (Lateral wet strength)/(Lateral dry strength) | — | 0.48 | 0.61 | 0.33 | 0.34 | 0.25 | 0.23 |
| | (Lateral wet strength)/[(Lateral dry strength) × (Average friction coefficient)] | — | 0.89 | 1.23 | 0.67 | 0.57 | 0.54 | 0.45 |
| | (Surface roughness)/(Average friction coefficient) | μm | 15.8 | 19.5 | 21.0 | 14.3 | 21.3 | 15.7 |
| | (Longitudinal dry strength/Lateral dry strength) | — | 3.9 | 2.6 | 4.4 | 2.8 | 1.8 | 3.3 |
| Results of sensory evaluation Evaluation based on seven grades | Water absorbency when tissue paper is used for wiping off | 1 to 7 | 3.0 | 3.0 | 4.0 | 4.5 | 3.5 | 3.2 |
| | Durability and firmness when tissue paper absorbs water | 1 to 7 | 4.6 | 5.0 | 4.0 | 4.2 | 4.3 | 4.4 |
| | Softness when tissue paper rubs skin | 1 to 7 | 4.7 | 5.2 | 4.0 | 3.7 | 3.3 | 3.4 |
| | Wiping-off smoothness and comfort when tissue paper is slid on skin | 1 to 7 | 4.3 | 4.5 | 4.0 | 4.0 | 4.6 | 4.4 |

TABLE 1-continued

| | | | Conventional Example 10 | Conventional Example 11 | Conventional Example 12 | Conventional Example 13 | Conventional Example 14 | Conventional Example 15 |
|---|---|---|---|---|---|---|---|---|
| Making of base paper | Blending of pulp (NBKP) | % | — | 40 | — | — | 40 | 40 |
| | Blending of pulp (LBKP) | % | — | 60 | — | — | 60 | 60 |
| | Crepe ratio | % | — | 14 | — | — | 14 | 14 |
| | Softener | kg/pulp ton | — | 0 | — | — | 0 | 0 |
| | Dry paper strength agent (cationized starch) | kg/pulp ton | — | 0 | — | — | 0 | 0 |
| | Wet paper strength agent (polyaminopolyamine epichlorohydrin resin) | kg/pulp ton | — | 8.5 | — | — | 8.5 | 8.5 |
| Quality of base paper | Base weight | $g/m^2$ | — | 12.4 | — | — | 10.6 | 15.2 |
| | Paper thickness | μm | — | 129 | — | — | 116 | 173 |
| | Dry tensile strength in longitudinal direction | cN/25 mm | — | 557 | — | — | 556 | 376 |
| | Dry tensile strength in lateral direction | cN/25 mm | — | 165 | — | — | 277 | 254 |
| | Wet tensile strength in lateral direction | cN/25 mm | — | 36 | — | — | 44 | 48 |
| Moisturizer | Kind of tissue | | Non-moisturizing | Non-moisturizing | Non-moisturizing | Non-moisturizing | Non-moisturizing | Non-moisturizing |
| | Content of polyol in paper | % by mass | — | — | — | — | — | — |
| | Base weight | $g/m^2$ | 14.6 | 12.2 | 10.7 | 11.5 | 10.4 | 14.9 |
| | Number of plies | sheets | 2 | 2 | 2 | 2 | 2 | 2 |
| Parameters of paper quality | Paper thickness | μm | 205 | 123 | 98 | 107 | 110 | 165 |
| | Dry tensile strength in longitudinal direction | cN/25 mm | 321 | 428 | 447 | 355 | 428 | 289 |
| | Dry tensile strength in lateral direction | cN/25 mm | 84 | 80 | 133 | 140 | 134 | 119 |
| | Elongation in longitudinal direction | % | 14.1 | 12.6 | 13.1 | 12.6 | 14.0 | 13.7 |
| | Wet tensile strength in lateral direction | cN/25 mm | 30 | 30 | 29 | 31 | 39 | 42 |
| | Surface roughness Ra | μm | 10.4 | 8.5 | 9.2 | 9.0 | 9.5 | 9.4 |
| | Average friction coefficient (μ) | — | 0.57 | 0.48 | 0.54 | 0.47 | 0.58 | 0.56 |
| | Softness | cN/100 mm | 0.9 | 0.9 | 1.1 | 1.2 | 1.0 | 1.1 |
| | MMD | — | 7.4 | 6.5 | 9.8 | 7.8 | 7.2 | 7.5 |
| | Web volume | mm | 82.0 | 62.0 | 41.0 | 47.0 | 47.0 | 73.0 |
| | Water absorption amount | $g/m^2$ | 391 | 328 | 250 | 289 | 297 | 388 |
| | Moisture content | % | 6.8 | 6.8 | 7.3 | 6.9 | 6.8 | 7.1 |
| | (Lateral dry strength) − (Lateral wet strength) | cN/25 mm | 54 | 50 | 104 | 109 | 95 | 77 |
| | (Lateral wet strength)/(Lateral dry strength) | — | 0.35 | 0.38 | 0.22 | 0.22 | 0.29 | 0.35 |
| | (Lateral wet strength)/[(Lateral dry strength) × (Average friction coefficient)] | — | 0.63 | 0.79 | 0.40 | 0.47 | 0.50 | 0.53 |
| | (Surface roughness)/(Average friction coefficient) | μm | 18.4 | 17.9 | 17.0 | 19.2 | 16.3 | 16.8 |
| | (Longitudinal dry strength/Lateral dry strength) | — | 3.8 | 5.4 | 3.4 | 2.5 | 3.2 | 2.4 |
| Results of sensory evaluation Evaluation based on seven grades | Water absorbency when tissue paper is used for wiping off | 1 to 7 | 4.2 | 3.6 | 28 | 2.6 | 2.6 | 4.2 |
| | Durability and firmness when tissue paper absorbs water | 1 to 7 | 4.0 | 4.2 | 4.0 | 4.0 | 4.5 | 4.6 |
| | Softness when tissue paper rubs skin | 1 to 7 | 4.0 | 4.2 | 3.4 | 3.2 | 3.8 | 4.0 |
| | Wiping-off smoothness and comfort when tissue paper is slid on skin | 1 to 7 | 3.8 | 4.5 | 4.0 | 4.5 | 3.9 | 4.0 |

From the results in Table 1, in Examples according to the present embodiment, the wet tensile strength in each of the longitudinal direction and the lateral direction is equivalent to that of a non-moisturizing tissue, and the wet tensile strength in the lateral direction is also high. That is, in Examples, the tissue paper has extremely excellent durability. Meanwhile, sensory evaluation values are remarkably better than those in Comparative Example and the conventional products. That is, it can be said that the tissue paper according to the present embodiment is a moisturizing tissue paper durable but also excellent in general "softness" not possessed by the conventional products, and also particularly excellent in "smoothness".

Furthermore, as illustrated in FIG. 2, also regarding "water absorbency when a tissue paper is used for wiping off", "durability and firmness when the tissue paper absorbs water", "softness when the tissue paper rubs the skin", and "wiping-off smoothness and comfort when the tissue paper is slid on the skin", which are sensory evaluation items in a specific use of makeup removal, extremely excellent results were obtained.

That is, the tissue paper according to the present invention is a moisturizing tissue excellent in the quality related to sensory performance and the quality related to sensory performance when being actually used by an actual user, and is a moisturizing tissue particularly excellent in general "softness" and having "durability (strength/sense of security)". Furthermore, the tissue paper according to the present invention has strength equivalent to a non-moisturizing tissue. In addition, the tissue paper according to the present invention is also excellent in general "smoothness". In addition, the tissue paper according to the present invention provides excellent feeling of use in a specific use mode such as use for removing makeup.

REFERENCE SIGNS LIST

1 Adhesive tape
2 Index finger
3 Tissue paper
5 Tactile force plate
5A Load cell
6 Plate

The invention claimed is:

1. A two-ply tissue paper comprising:

a two-ply tissue paper sheet; and 22.5 to 28.5 mass % of a polyol-containing moisturizer added to the two-ply tissue paper sheet, the polyol-containing moisturizer comprising 60 to 90% polyol, the two-ply tissue paper having:

(i) a basis weight of 16.0 to 25.0 g/m$^2$ per ply;

(ii) a two-ply paper thickness of 145 to 180 μm;

(iii) a dry tensile strength of 120 to 200 cN/25 mm in a lateral direction;

(iv) a dry tensile strength of 275 to 450 cN/25 mm in a longitudinal direction;

(v) a wet tensile strength of 80 to 120 cN/25 mm in the lateral direction;

(vi) a difference of 40 cN/25 mm or more between the dry tensile strength in the lateral direction and the wet tensile strength in the lateral direction and a value of (wet tensile strength in lateral direction)/(dry tensile strength in lateral direction) of 0.60 to 0.75;

(vii) an elongation percentage of 13.0 to 18.0% in the longitudinal direction; and (viii) a surface roughness Ra of 10.0 to 12.0 μm.

2. The tissue paper according to claim 1, having an average friction coefficient μ of 0.38 to 0.50.

3. The tissue paper according to claim 1, having a value of (surface roughness Ra)/(average friction coefficient μ) of 25.0 to 30.0 μm, and a value of (wet tensile strength in lateral direction)/[(dry tensile strength in lateral direction)×(average friction coefficient μ)] of 1.45 to 2.00.

* * * * *